US007377796B2

(12) United States Patent
Matsumura et al.

(10) Patent No.: US 7,377,796 B2
(45) Date of Patent: May 27, 2008

(54) CONNECTOR

(75) Inventors: Kaoru Matsumura, Makinohara (JP); Tomoya Sannomiya, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/634,880

(22) Filed: Dec. 7, 2006

(65) Prior Publication Data

US 2007/0128902 A1 Jun. 7, 2007

(30) Foreign Application Priority Data

Dec. 7, 2005 (JP) ..... 2005-353748

(51) Int. Cl.
*H01R 13/62* (2006.01)

(52) U.S. Cl. ..... 439/157; 439/372; 439/160

(58) Field of Classification Search ..... 439/157, 439/372, 160

See application file for complete search history.

(56) References Cited

U.S. PATENT DOCUMENTS 6,162,072 A * 12/2000 Hoyer et al. ..... 439/157
6,439,902 B1 * 8/2002 Cole et al. ..... 439/157
6,755,674 B2 * 6/2004 Fujii et al. ..... 439/157
6,832,922 B2 * 12/2004 Kozono et al. ..... 439/135
2006/0211286 A1 * 9/2006 Shuey ..... 439/157
2006/0270258 A1 * 11/2006 Ohtaka et al. ..... 439/157
2006/0281350 A1 * 12/2006 Yamamoto ..... 439/157

FOREIGN PATENT DOCUMENTS

JP 5-129048 A 5/1993

* cited by examiner

*Primary Examiner*—Gary F. Paumen
(74) *Attorney, Agent, or Firm*—Sughrue Mion, PLLC

(57) ABSTRACT

In a connector 1 comprising: a connector housing 11 including two guide grooves 25 respectively for receiving two cam pins 15, and a lever 12 including two cam grooves 44 respectively engageable with the cam pins 15 and rotatably supported on the connector housing 11, wherein, in the initially engaged state of the connector 1 with a partner connector 2, the cam pins 15 are disposed in the entrance openings of the guide grooves 25 and the cam grooves 44, and, when the lever 12 is operated and rotated, the cam pins 15 are respectively engaged with the cam grooves 44 and are pushed deep into the guide grooves 25, whereby the connector 1 is completely engaged with the partner connector 2; and, the connector 1 further including a dustproof cover 13 removably mounted on the connector housing 11 for covering the insertion opening of the connector housing 11 into which the partner connector 2 can be inserted, wherein the dustproof cover 13 includes a pressure portion 54*a* to be pressed against the lever 12 and, by applying pressure to the lever 12 using the pressure portion 54*a*, the lever 12 can be held at its initial position where the entrance openings of the cam groove 44 coincide with the entrance openings of the guide grooves 25.

4 Claims, 10 Drawing Sheets

CONNECTOR

BACKGROUND OF THE INVENTION

1. Field of the Invention

The present invention relates to a connector which can be engaged with a partner connector by rotationally operating a lever.

2. Description of the Related Art

Conventionally, as a connector which can be engaged with a partner connector by rotationally operating a lever, there is known a connector shown in FIG. 10 (for example, see Japanese Patent Publication Hei-5-129048).

As shown in FIG. 10, a connector 100 disclosed in Patent Reference 1 includes a female connector 101, a frame 102 to be mounted on the female connector 101, and a male connector 105 including a cam pin 106 provided on and projected from the male connector 105.

In the female connector 101, there are formed pin guide grooves 103 which respectively extend backwardly from the insertion opening of the female connector 101 into which the male connector 105 can be inserted. And, in the frame 102 as well, there are formed guide grooves 104 which can coincide with the pin guide grooves 103 of the female connector 101 in a state where the frame 102 is mounted on the female connector 101.

And, a lever 107 is rotatably mounted on the frame 102 and, in the lever 107, there is formed a cam groove 108. The cam groove 108 is structured such that, in a state where the lever 107 is held at an initial position (a position shown in FIG. 10), the entrance opening of the cam groove 108 coincides with the entrance opening of the pin guide groove 104 and the cam groove 108 extends from the entrance opening thereof so as to approach gradually the rotation axis of the lever 107.

When the male connector 105 is inserted into the female connector 101 with the frame 102 mounted thereon, the cam pin 106 of the male connector 105 not only enters the entrance openings of the pin guide groove 103 of the female connector 101 and the pin guide groove 104 of the frame 102 but also enters the entrance opening of the cam groove 108 of the lever 107 held at the initial position, so that the cam pin 106 is engaged with the cam groove 108.

And, when the lever 107 is operated and rotated, the cam groove 108 catches the cam pin 106 and pushes the cam pin 106 toward the rear ends of the guide grooves 103 and 104, whereby the female and male connectors 101 and 105 can be completely engaged with each other.

However, in the lever type connector 100 disclosed in Patent Reference 1, when the lever 107 is not held at the initial position and the entrance opening of the cam groove 108 of the lever 107 is not coincident with the entrance opening of the pin guide groove 104 of the frame 102, the cam pin 106 of the male connector 105 cannot be made to enter the pin guide groove 103 of the female connector 101 and the pin guide groove 104 of the frame 102, with the result that the female and male connectors 101 and 105 cannot be engaged with each other. Therefore, it takes time and labor to return the lever 107 to the initial position.

In view of this, in the connector 100, in the frame 102 and lever 107, there are provided engaging projections which can be engaged with each other, so that the lever 107 can be held stably at the initial position due to the mutual engagement of these engaging projections.

However, if sufficient strength to positively hold the lever 107 at the initial position is given to the engagement of the engaging projections, when rotating the lever 107 for bringing the female and male connectors 101 and 105 into mutual engagement, there is necessary great power to remove the engagement between the engaging projections, which raises a fear that the operation efficiency of the connector can be lowered.

On the other hand, when the strength of the engagement between the engagement projections is set relatively low while priority is given to the operation efficiency in engaging the female and male connectors 101 and 105, there is a fear that, for example, while delivering the connector 100, an external force can be applied to the lever 107 due to the contact of the connector 100 with other connector to thereby remove the engagement between the engaging projections easily. Especially, since the lever 107 is exposed to the outside, there is a relatively high possibility that an external force can be applied to the lever 107.

SUMMARY OF THE INVENTION

The present invention is made in view of the above circumstances of the prior art. And thus, it is an object of the invention to provide a connector of a type that it can be engaged with a partner connector by rotationally operating a lever, in which the lever can be positively held at an initial position before the connector is engaged with the partner connector to thereby provide no obstacle to an operation for engaging the connector with the partner connector.

The above object can be attained by a connector as set forth in the following articles (1)-(4).

(1) A connector, comprising: a connector housing including a guide groove for receiving a cam pin, and a lever including a cam groove engageable with the cam pin and rotatably supported on the connector housing, wherein, in the initially engaged state of the connector with a partner connector, the cam pin is disposed in the entrance openings of the guide groove and the cam groove, and, when the lever is operated and rotated, the cam pin is engaged with the cam groove and pushed deep into the guide groove, whereby the connector is completely engaged with the partner connector; and, the connector further including a dustproof cover removably mounted on the connector housing for covering the insertion opening of the connector housing into which the partner connector can be inserted, wherein the dustproof cover includes a pressure portion for pressing the lever and, by pressing the lever using the pressure portion, the lever can be held at its initial position where the entrance opening of the cam groove coincides with the entrance opening of the guide groove.

(2) A connector as set forth in the article (1), wherein the lever and the connector housing respectively include engaging portions which can be engaged with each other when the lever is held at the initial position.

(3) A connector as set forth in the article (1) or (2), wherein the dustproof cover includes a hood portion for covering the lever.

(4) A connector as set forth in the article (3), wherein the pressure portion is composed of a rib which is vertically provided on the inner surface of the hood portion.

According to a connector as set forth in the article (1), the connector includes the dustproof cover which is removably mounted on the connector housing and covers the insertion opening of the connector housing into which the partner connector can be inserted. Such dustproof cover is used to prevent a foreign object such as dust from entering the engaging portion of the connector with the partner connector before the connector is engaged with the partner connector, while the dustproof cover is removed from the connector housing when the connector is engaged with the partner connector. In the dustproof cover, there is arranged a pressure portion for pushing the lever; and, the lever can be pushed by the pressure portion and can be thereby held at the initial position. And, as described above, since the dustproof cover is removed from the connector housing just before the connector is engaged with the partner connector, by pushing the lever using the dustproof cover, the lever can be positively held at the initial position before the connector is engaged with the partner connector.

According to a connector as set forth in the article (2), the lever and connector housing respectively include engaging portions which can be engaged with each other in a state where the lever is held at the initial position, the engagement of these engaging portions makes it possible to provisionally hold the lever at the initial position even after the dustproof cover is removed, which ensures the positive holding of the lever at the initial position. And, before the engagement of the connector with the partner connector, as described above, since the lever can be held at the initial position by the dustproof cover, there is no need to apply high strength to the engagement between the engaging portions. Thus, when the dustproof cover is removed and the connector is engaged with the partner connector, the engagement between the engaging portions can be removed easily and thus the lever can be rotated positively, which provides no obstacle to the operation for engaging the connector with the partner connector.

According to a connector as set forth in the article (3), since the dustproof cover includes a hood portion for covering the lever, when compared with a structure in which a lever is exposed, there can be reduced a possibility that an external force can be applied to the lever, which makes it possible to hold the lever at the initial position more positively.

According to a connector as set forth in the article (4), because the pressure portion is composed of a rib which is vertically provided on the inner surface of the hood portion of the dustproof cover, simultaneously when the dustproof cover is mounted onto the connector housing, the lever can be pushed by the pressure portion, thereby being able to return the lever to the initial position positively.

According to the invention, there can be provided a connector of a type that it can be engaged with a partner connector by rotationally operating a lever, in which the lever can be positively held at an initial position before the connector is engaged with the partner connector to thereby provide no obstacle to an operation for engaging the connector with the partner connector.

DESCRIPTION OF THE PREFERRED EMBODIMENTS

Now, description will be given below in detail of several preferred embodiments of a connector according to the invention with reference to the accompanying drawings.

Figure 1:
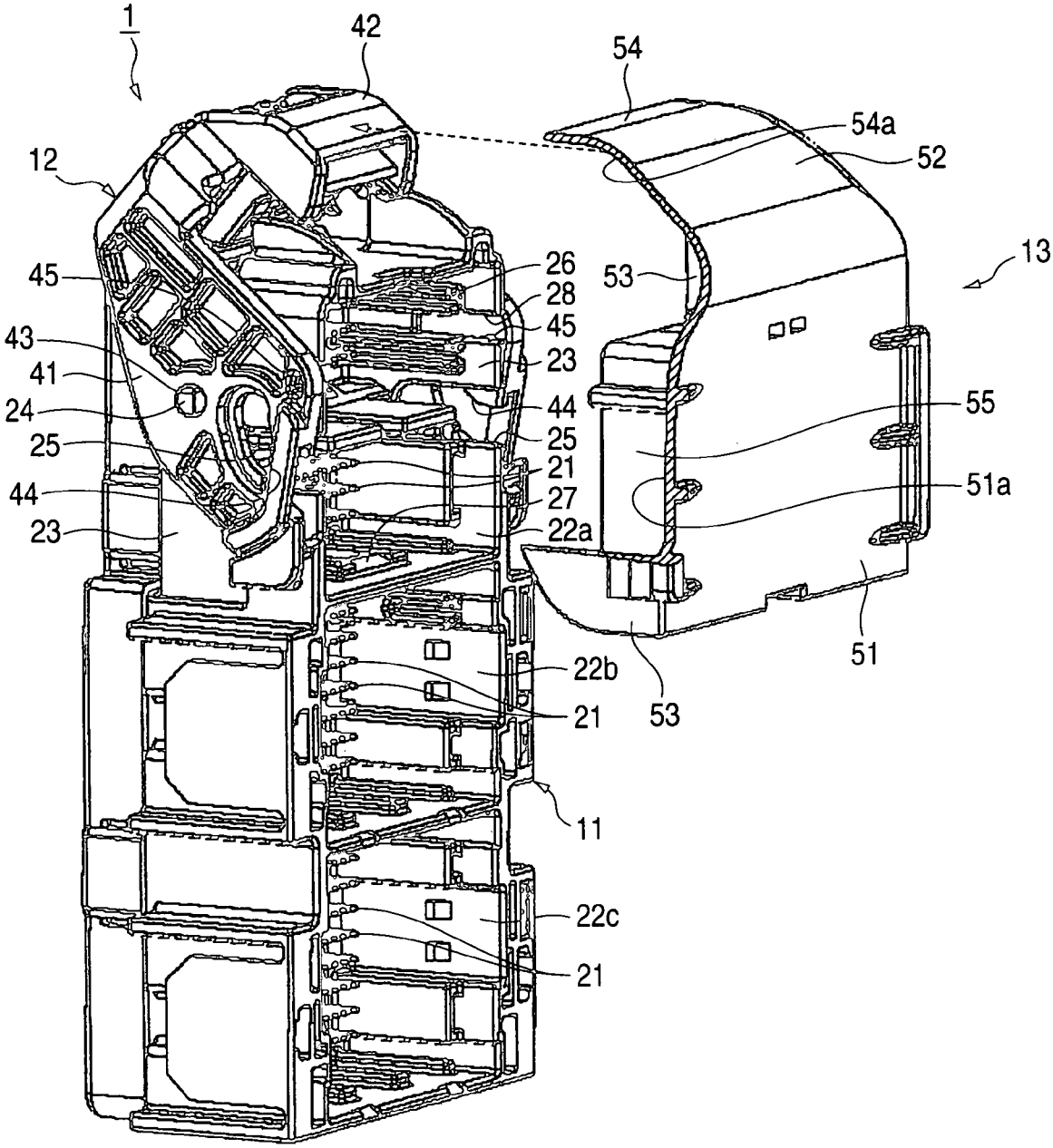
FIG. 1 is a perspective view of the appearance of an embodiment of a connector according to the invention.
Figure 2:
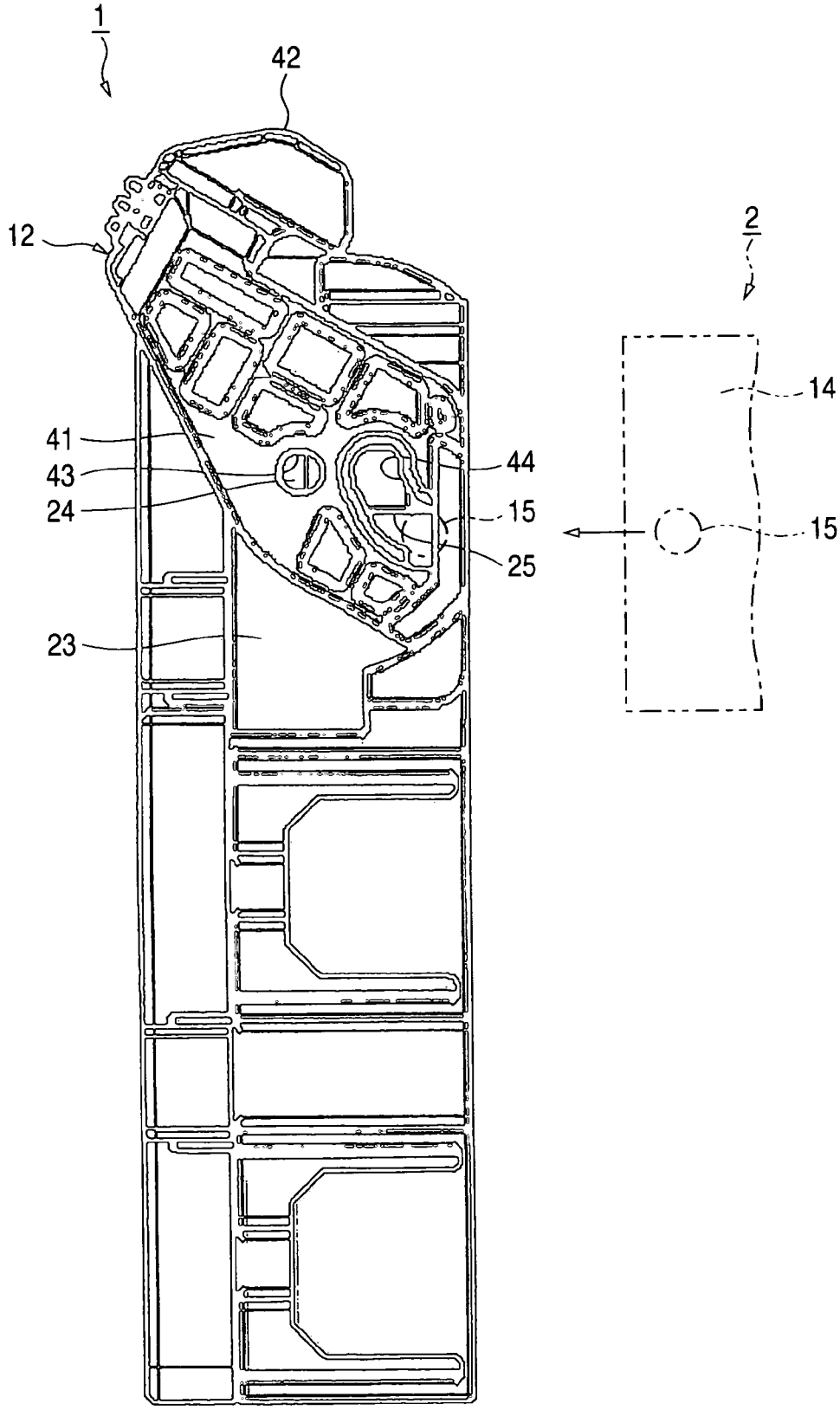
FIG. 2 is a side view of the connector shown in FIG. 1, showing the process for engaging the connector and its partner connector.
Figure 3:
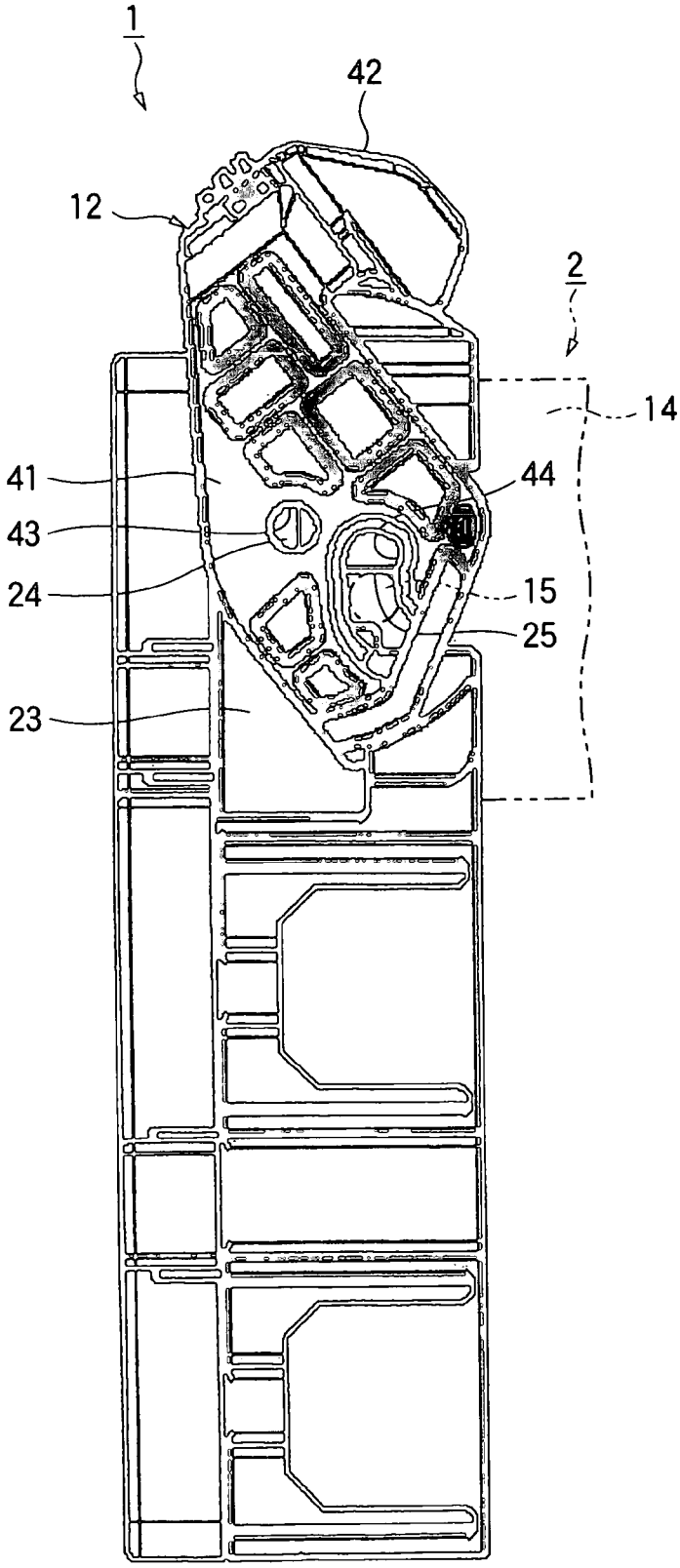
FIG. 3 is a side view of the connector shown in FIG. 1, showing a state in which it is completely engaged with the partner connector.
Figure 4:
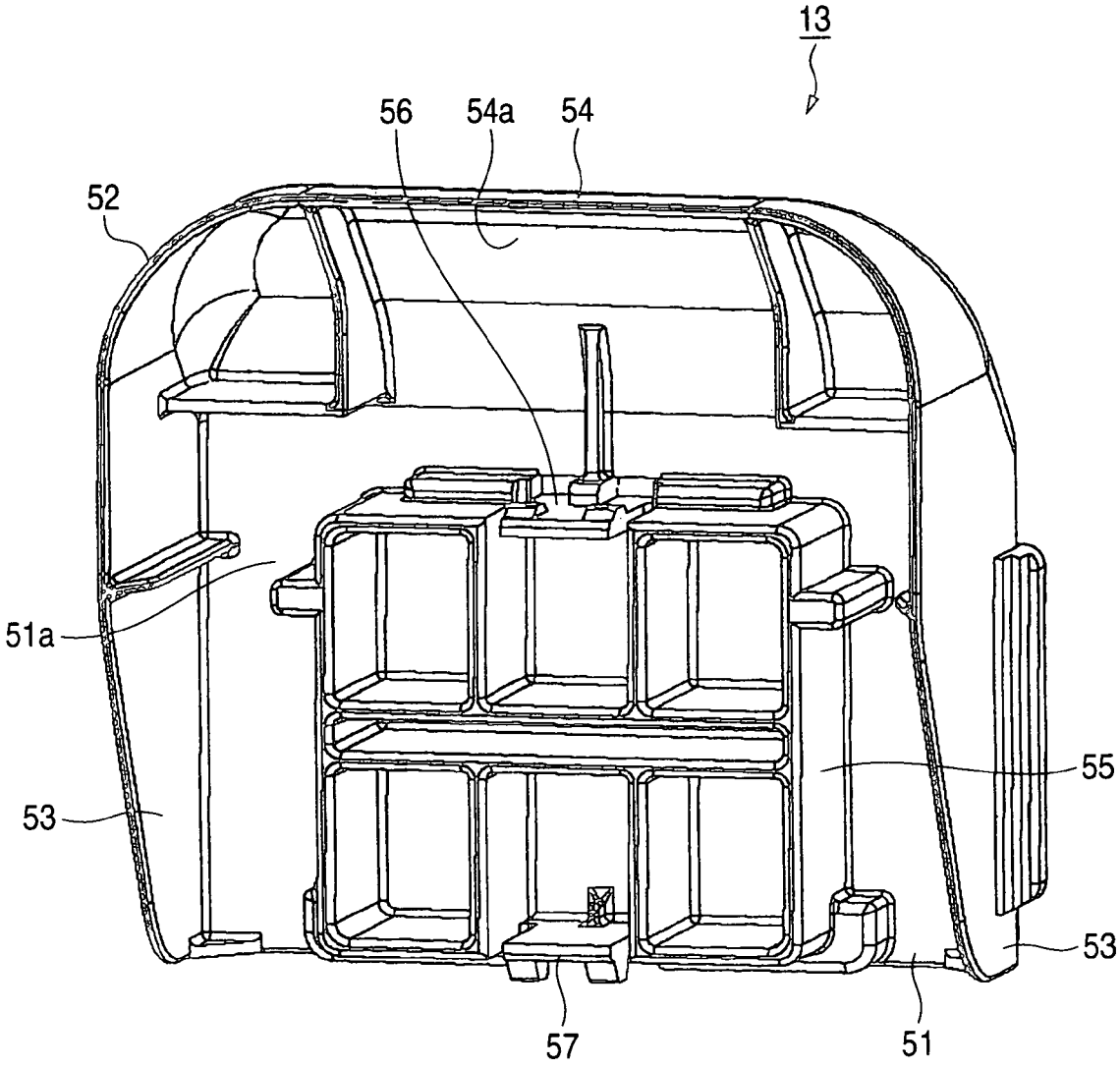
FIG. 4 is a perspective view of a dustproof cover alone.
Figure 5:
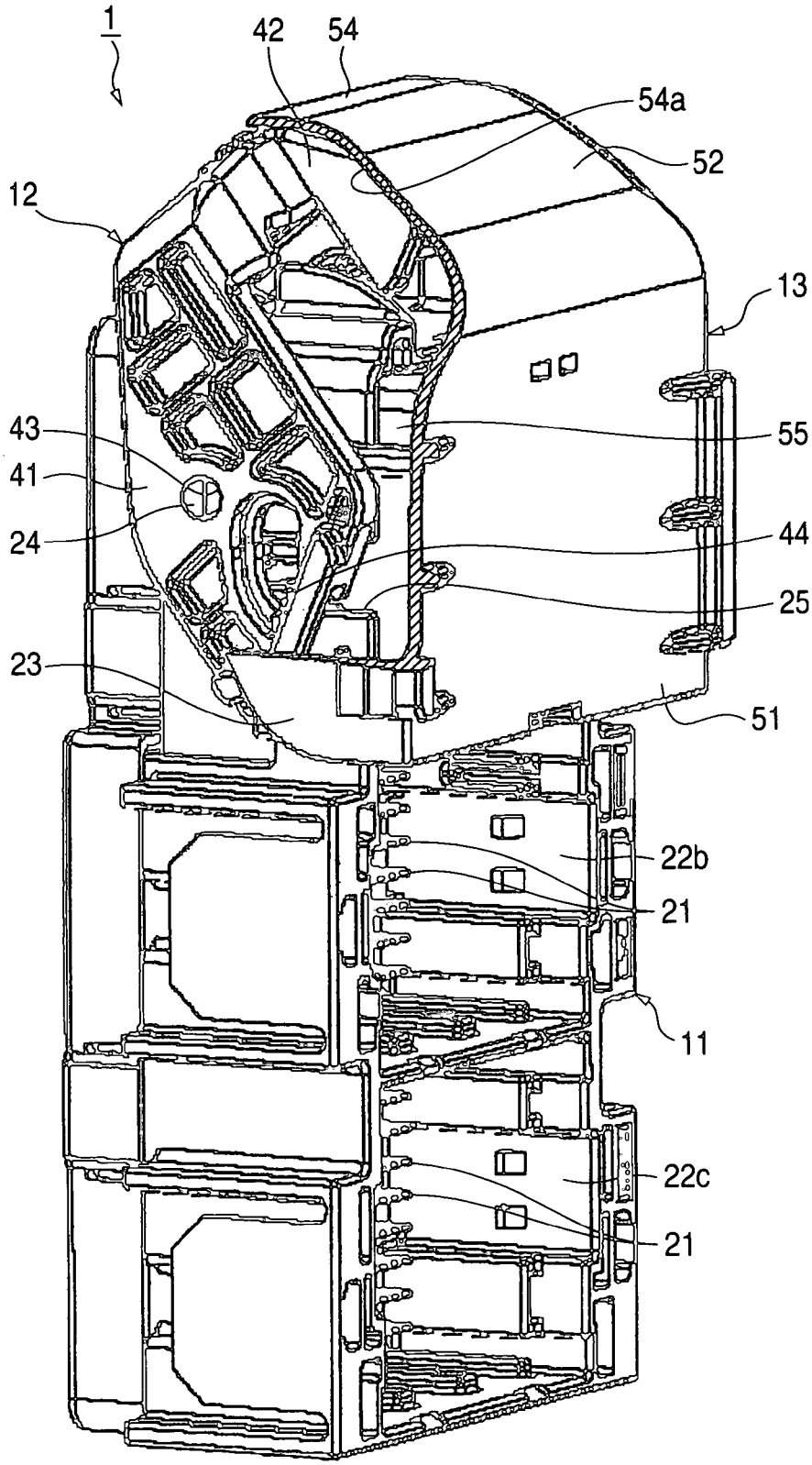
FIG. 5 is a perspective view of the connector shown in FIG. 1 just before the dustproof cover is mounted onto the connector.
Figure 6:
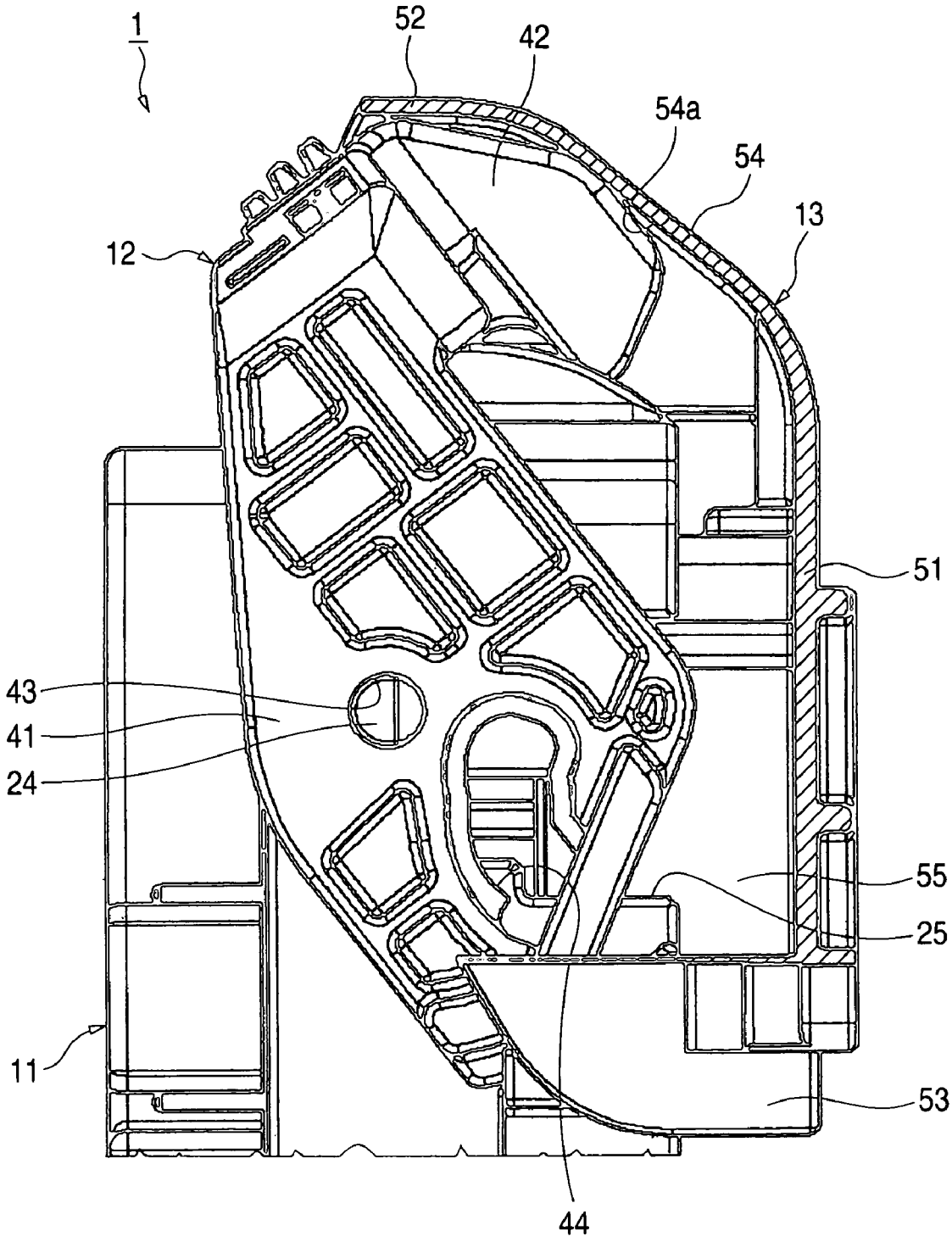
FIG. 6 is a partially broken enlarged side view of the main portions of the dustproof cover of the connector shown in FIG. 5.
Figure 7:
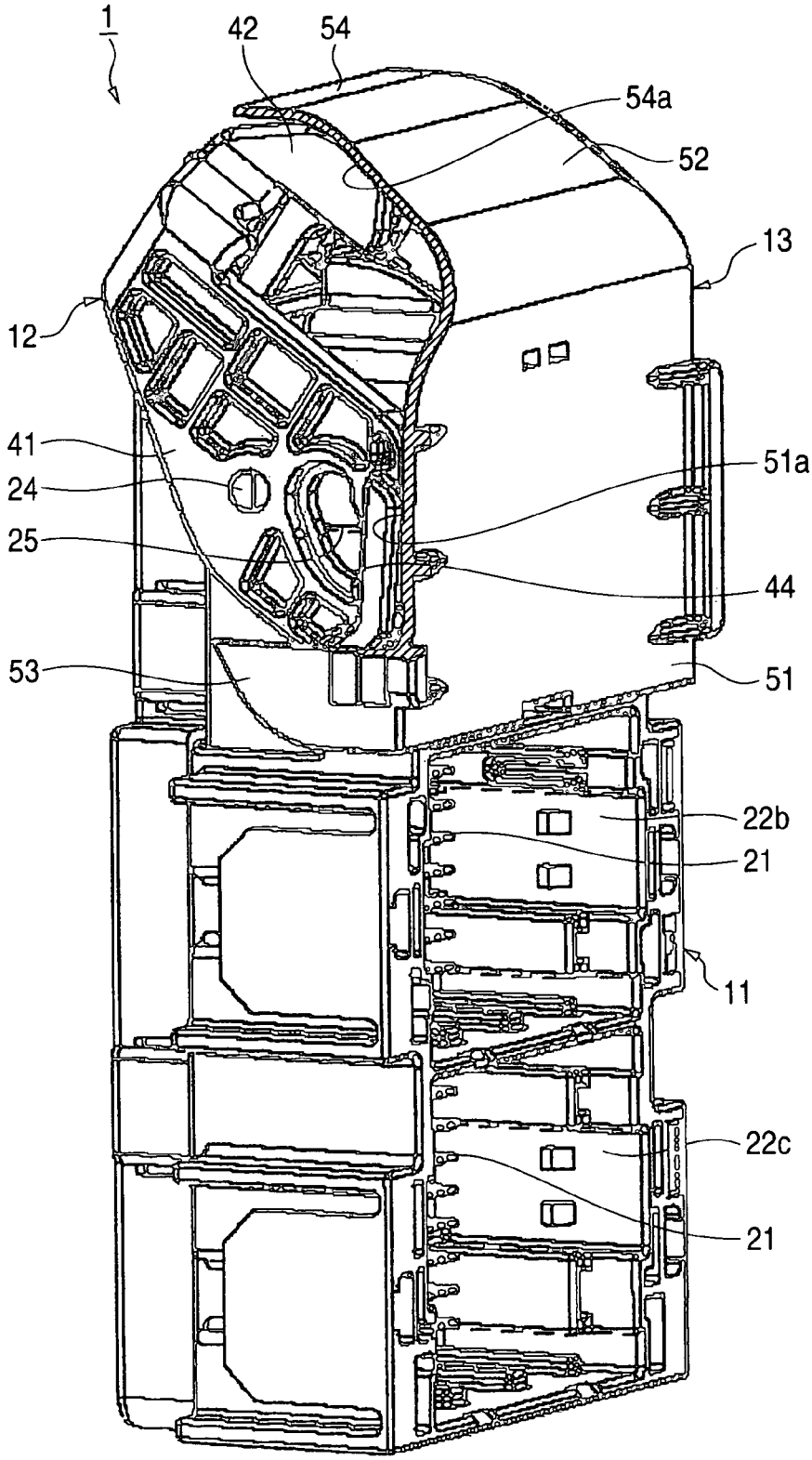
FIG. 7 is a perspective view of the connector shown in FIG. 1, showing a state thereof after the mounting of the dustproof cover onto the connector is completed.
Figure 8:
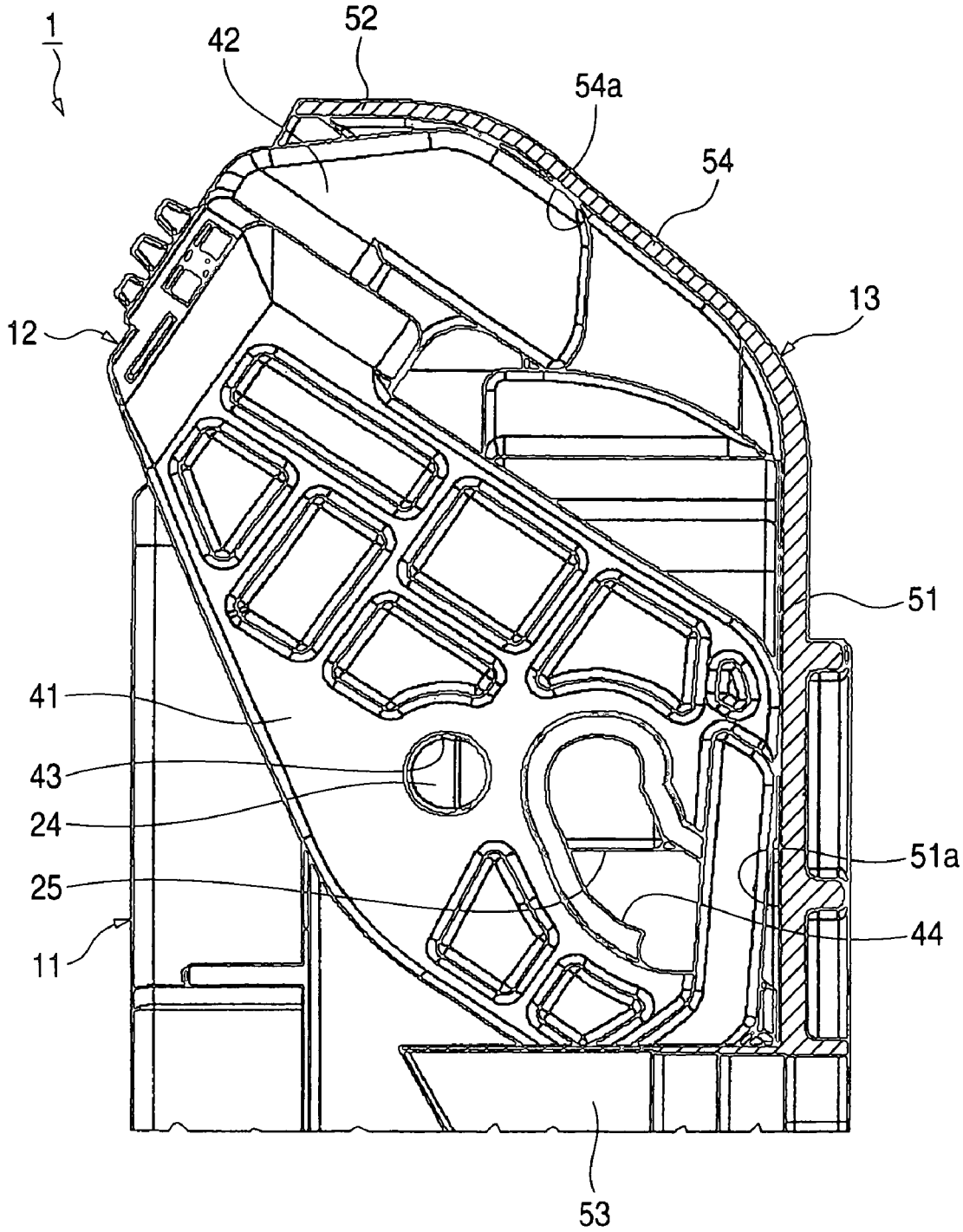
FIG. 8 is a partially broken enlarged side view of the dustproof cover of the connector shown in FIG. 7.

FIG. 1 is a perspective view of the appearance of an embodiment of a connector according to the invention; FIG. 2 is a side view of the connector shown in FIG. 1, showing the process for engaging the connector with its partner connector; FIG. 3 is a side view of the connector shown in FIG. 1, showing a state in which it is completely engaged with the partner connector; FIG. 4 is a perspective view of a dustproof cover alone; FIG. 5 is a perspective view of the connector shown in FIG. 1 just before the dustproof cover is mounted onto the connector; FIG. 6 is a partially broken enlarged side view of the main portions of the dustproof cover of the connector shown in FIG. 5; FIG. 7 is a perspective view of the connector shown in FIG. 1, showing a state thereof after the mounting of the dustproof cover on the connector is completed; and, FIG. 8 is a partially broken enlarged side view of the dustproof cover of the connector shown in FIG. 7.

As shown in FIG. 1, a connector 1 according to the present embodiment comprises a connector housing 11, a lever 12 rotatably supported on the connector housing 11, and a dustproof cover 13 which can be removably mounted on the connector housing 11. By the way, in the following description of the present specification, a direction in which the connector 1 is connected with its partner connector is regarded as the forward direction of the connector 1.

The connector housing 11, which is a so called female-type connector housing, is opened forwardly and includes terminal storage rooms 22*a-c* each storing two or more terminals 21 therein, while these terminal storage rooms 22*a-c* are arranged such that they are superimposed on top of each other in the vertical direction. Into these terminal storage rooms 22*a-c*, there are inserted and fitted the male-type connector housings, of the partner connector respectively; and, with the two or more terminals stored in each terminal storage room, there are respectively connected two or more terminals held in the partner connector which has been inserted into and engaged with the connector 1.

On the two outside surfaces of the connector housing 14 of the partner connector 2 (see FIG. 2) to be inserted into and engaged with the terminal storage room 22*a* set in the highest stage, there are projectingly provided substantially cylindrical-shaped cam pins 15 respectively. In the two side wall portions 23 of the terminal storage room 22*a*, there are respectively formed guide grooves 25 which extend backward in parallel to the engaging direction of the two connectors 1 and 2 from the front end edge of the terminal storage room 22*a* defining the opening (insertion opening into which the partner connector 2 can be inserted) of the terminal storage room 22*a* and into which the cam pins 15 advance as the partner connector 2 is inserted and fitted into the terminal storage room 22*a*.

The lever 12 includes a pair of flat-plate-shaped arm portions 41 disposed so as to hold the terminal storage room 22*a* set at the highest stage of the connector housing 11 from both side, and an operation portion 42 for connecting together the upper ends of the pair of arm portions 41 that project upwardly of the connector housing 11; and, the whole of the lever 12 is formed substantially in a U shape.

On the portions of the outer surfaces of the two side wall portions defining the terminal storage room 22*a* that exit further backward of the rear ends of the guide grooves 25, there are respectively provided substantially cylindrical-shaped projections 24 which serve as the rotation shafts of the lever 12; and, in the pair of arm portions 41 of the lever 12, there are respectively opened up shaft holes 43 into which the projections 24 provided on the mutually opposing side wall portions 23 can be inserted and fitted. While the shaft holes 43 of the respective arm portions 41 are respectively engaged with the projections 24 of the side wall portions 23 of the terminal storage room 22*a*, the lever 12 is supported on the connector housing 11 in such a manner that it can be rotated with these projections 24 as the rotation shafts thereof.

In the two arm portions 41 of the lever 12, there are respectively formed cam grooves 44 which not only receive the leading end portions of the cam pins 15 of the partner connector 2 respectively projecting outside the side walls 23 through the guide grooves 25 provided in the side wall portions 23 of the terminal storage room 22*a* but also can be engaged with the leading end portions of the cam pins 15. The cam grooves 44 are formed such that, in a state that the lever 12 is held at its initial position (position shown in FIG. 2) where it is inclined backward, the entrance openings thereof coincide with the entrance openings of the guide grooves 25 and they extend from the entrance openings thereof so as to gradually approach the shaft holes 43.

As shown in FIG. 2, in the state where the lever 12 is held at the initial position, the entrance openings of the cam grooves 44 of the lever 12 coincide with the entrance openings of the guide grooves 25 of the side wall portions of the terminal storage room 22*a*. And, in this state, when the partner connector 2 is inserted into the terminal storage room 22*a*, the cam pins 25 of the partner connector 2 are inserted into the guide grooves 25 and cam grooves 44.

As the lever 12 is operated or rotated from the initial engaged state, where the cam pins 15 of the partner connector 2 are disposed in the entrance openings of the cam grooves 44 of the lever 12 and in the entrance openings of the guide grooves 25 of the side wall portions of the terminal storage room 22*a*, and is thereby inclined forwardly, as shown in FIG. 3, the mutually intersecting portions of the cam grooves 44 and guide grooves 25 are moved toward the rear ends of the guide grooves 25, and the cam pins 15, the leading end portions of which are engaged with the cam grooves 44, are drawn into the cam grooves 44 and are thereby pushed toward the rear ends of the guide grooves 25, whereby the two connectors 1 and 2 can be engaged with each other completely.

In the state where the two connectors 1 and 2 are in complete engagement with each other, while the guide grooves 25 extend in the back-and-forth direction, the cam grooves 44 of the lever 12 operated and rotated extend in the vertical direction; and thus, the entrance openings of the cam grooves 44 are not coincident with the entrance openings of the guide grooves 25 any longer. Owing to this, the displacement of the cam pins 15 of the partner connector 2 respectively received by the guide grooves 25 and cam grooves 44 is restricted, which prevents the two connectors 1 and 2 against removal from each other.

Here, when the lever 12 is inclined forwardly as shown in FIG. 3 before the partner connector 2 is inserted into the terminal storage room 22*a*, since the entrance openings of the guide grooves 25 are not coincident with the entrance openings of the cam grooves 44, the cam pins 15 of the partner connector 2 interfere with the front end edges of the arm portions 41 of the lever 12 and thus are not be able to enter the guide grooves 25 and cam grooves 44, with the result that the two connectors 1 and 2 cannot be engaged with each other. In view of this, in the connector 1 according to the present embodiment, by pushing and fixing the lever 12 using the dustproof cover 13, the lever 12 can be held at the initial position.

As shown in FIGS. 1 and 4, the dustproof cover 13 includes a rectangular flat-plate-shaped cover portion 51 for closing the opening of the terminal storage room 22*a* to prevent a foreign object such as dust from entering the interior of the terminal storage room 22*a*, and a hood portion 52 composed of side wall portions 53 respectively vertically provided on the two side edges of the cover portion 51 and upper wall portions respectively provided perpendicularly on the upper edge of the cover portion 51.

On the central portion of the inner surface 51*a* of the cover portion 51, a prism-shaped terminal protect portion 55 which goes into the terminal storage room 22*a* and stores two or more terminals 21 therein. The interior of the terminal protect portion 55 is divided by partition walls into two or more sections (in FIG. 4, six sections). Two or more terminals existing within the terminal storage room 22*a* are divided into two or more groups and every group of terminals 21 are stored in a given section of the terminal protect portion 55, thereby being able to prevent the terminals 21 from being bent.

On the upper wall portion of the terminal protect portion 55, there is provided an elastic engaging piece 56 which is formed by separating a portion of the upper wall portion from the other remaining portions thereof; and also, on the lower wall portion of the terminal protect portion 55, there is provided an elastic engaging piece 57 which is formed by separating a portion of the lower wall portion from the other remaining portions thereof. While engaging pawls respectively provided on the leading end portions of the elastic engaging pieces 56 and 57 are respectively engaged with engaging portions 26 and 27 respectively formed in the inner surfaces of the upper and lower wall portions defining the terminal storage rooms 22*a*, the dustproof cover 13 is removably mounted onto the connector housing 11.

The hood portion 52 is formed such that, when the dustproof cover 13 is mounted onto the connector housing 11, the respective side wall portions 53 cover the arm portions 41 of the lever 12 and the upper wall portion 54 covers the operation portion 42 of the lever 12. And, the inner surface 54*a* is used as a pressure portion which, as the dustproof cover 13 is mounted onto the connector housing 11, pushes the operation portion 42 of the lever 12.

Now, description will be given below of how to mount the dustproof cover 13 onto the connector housing 11 with reference to FIGS. 5 to 8. FIGS. 5 and 6 show a state just before the dustproof cover 13 is mounted onto the connector housing 11. Here, the lever 12 is inclined forwardly and is thus out of the initial position.

The dustproof cover 13 is moved in the following manner: that is, while inserting the terminal protect portion 55 into the terminal storage room 22*a*, not only the arm portions 41 of the lever 12 are stored in clearances respectively formed between the side wall portions 53 and the side wall portions 23 of the terminal storage room 22*a* opposed to the side wall portions 53, but also the operation portion 42 of the lever 12 is stored in a clearance formed between the upper wall portion 54 and the upper wall portion of the terminal storage room 22*a* opposed to the upper wall portion 54, whereby the opening of the terminal storage room 22*a* is covered from ahead by the cover portion 51. In the movement of the dustproof cover 13, the inner surface 54*a* of the upper wall portion 54 of the dustproof cover 13 is contacted with the operation portion 42 of the lever 12 which is inclined forwardly.

As the dustproof cover 13 is moved further, while the front end face of the operation portion 42 of the lever 12 slides on the inner surface 54*a* of the upper wall portion 54 of the dustproof cover 13, the operation portion 42 is pushed further backwardly by the upper wall portion 54, whereby the lever 12 is inclined backwardly and is thereby returned back to the initial position. And, as shown in FIGS. 7 and 8, at the same time when the lever 12 is held at the initial position, the engaging pawls of the elastic securing pieces 56 and 57 of the dustproof cover 13 are respectively engaged with the engaging portions 26 and 27 of the terminal storage room 22*a*, whereby the dustproof cover 13 is mounted onto the connector housing 11.

In a state where the dustproof cover 13 is mounted on the connector housing 11, the inner surface 54*a* of the upper wall portion 54 of the dustproof cover 13 is pressed against the operation portion 42 of the lever 12 and also the inner surface 51*a* of the cover portion 51 of the dustproof cover 13 is pressed against the front end edges of the arm portions 41 of the lever 12, whereby the lever 12 is prevented from inclining forwardly and thus can be held at the initial position.

When engaging the partner connector 2 with the connector 1 with the dustproof cover 13 mounted on the connector housing 11 thereof, although the dustproof cover 13 is removed from the connector housing 11, just after removal of the dustproof cover 13, the lever 12 is held at the initial position, while the entrance openings of the guide grooves 25 formed in the side wall portions 23 of the terminal storage rooms 22*a* are coincident with the entrance openings of the cam grooves 44 formed in the arm portions 41 of the lever 12. Therefore, the cam pins 15 of the partner connector 2 can be inserted into the guide grooves 25 and cam grooves 44 with no interference with the front end edges of the arm portions 41 of the lever 12. That is, the two connectors 1 and 2 are held in a state where they can be engaged with each other at once.

And, as shown in FIG. 1, in the connector 1 according to the present embodiment, in order that, until the partner connector 2 is engaged with the connector 1 after the dustproof cover 13 is removed, the lever 12 can be prevented from inclining forward from the initial position, in the arm portions 41 of the lever 12 and in the side wall portions 23 of the terminal storage room 22*a*, there are provided engaging projections 45 and engaging grooves 28 which can be engaged with each other when the lever 12 is held at the initial position.

According to the present embodiment, the connector 1 includes the dustproof cover 13 which can be removably mounted onto the connector housing 11 and also can cover the insertion opening of the connector 1 into which the partner connector 2 can be inserted. This dustproof cover 13 is used to prevent a foreign object such as dust from entering the terminal storage room 22*a*, which is the engaging portion of the connector 1 with the partner connector 2, before the connector 1 is engaged with the partner connector 2, and; when the connector 1 is engaged with the partner connector 2, the dustproof cover 13 is to be removed. And, the dustproof cover 13 includes the upper wall portion 54 of the hood portion 52 which serves as the pressure portion for pressing the lever 12; and thus, the lever 12 can be pressed by the upper wall portion 54 and can be thereby held at the initial position. Also, as described above, since the dustproof cover 13 is removed from the connector housing 11 just before the connector 1 is engaged with the partner connector 2, by pressing the dustproof cover 13 against the lever 12, before the connector 1 is engaged with the partner connector 2, the lever 12 can be positively held at the initial position.

In the connector 1 according to the present embodiment, the lever 12 and connector housing 11 respectively include the engaging projections 45 and engaging grooves 28 respectively serving as engaging portions which can be engaged with each other when the lever 12 is held at the initial position; and, the mutual engagement of these engaging portions makes it possible to hold the lever 12 provisionally at the initial position even after removal of the dustproof cover 13, thereby ensuring that the lever 12 can be held at the initial position. And, since, before the engagement of the connector 1 with the partner connector 2, as described above, the lever 12 can be held at the initial position by the dustproof cover 13, it is not necessary to apply high strength to the engagement between the engaging projections 45 and engaging grooves 28. Therefore, when the dustproof cover 13 is removed and the connector 1 is engaged with the partner connector 2, the engagement between the engaging projections 45 and engaging grooves 28 can be removed easily and the lever 12 can be rotated, with the result that there is produced no obstacle to the engaging operation of the connector 1 with the partner connector 2.

Further, according to the connector 1 of the present embodiment, the dustproof cover 13 includes the hood portion 52 for covering the lever 12. When compared with a structure in which the lever 12 is exposed, there can be reduced a possibility that an external force can be applied to the lever 12. This makes it possible to hold the lever 12 at the initial position more positively.

Next, description will be given below of a modification of the above-mentioned connector 1 with reference to FIG. 9. By the way, the connector according to the present modification is different from the above-mentioned connector 1 only in the details of a dustproof cover. And thus, the description of the parts of the modification used in common with the above-mentioned connector 1 is omitted or simplified.

Figure 9:
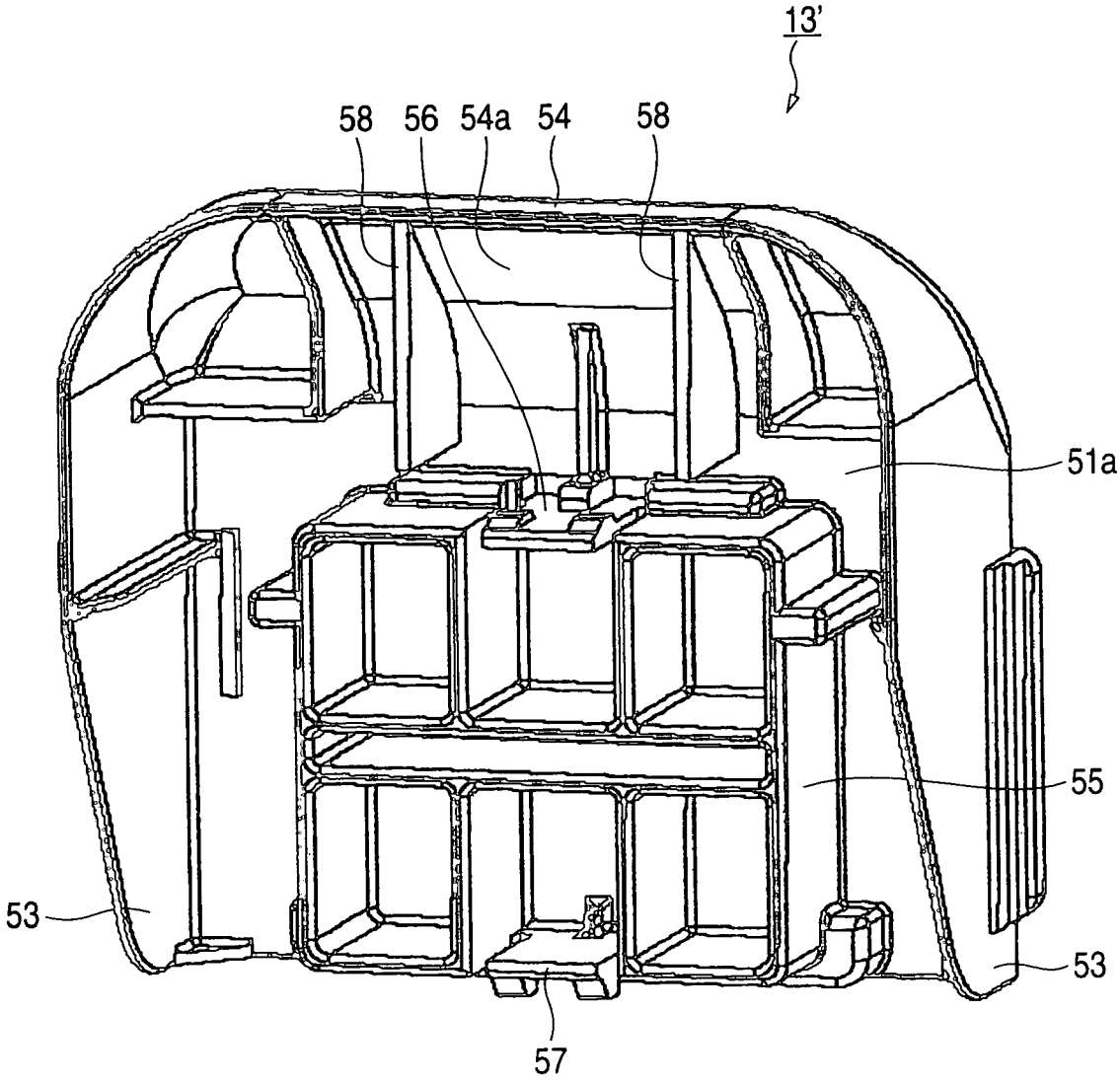
FIG. 9 is a perspective view of a dustproof cover alone used in a modification of the connector shown in FIG. 1.
Figure 10:
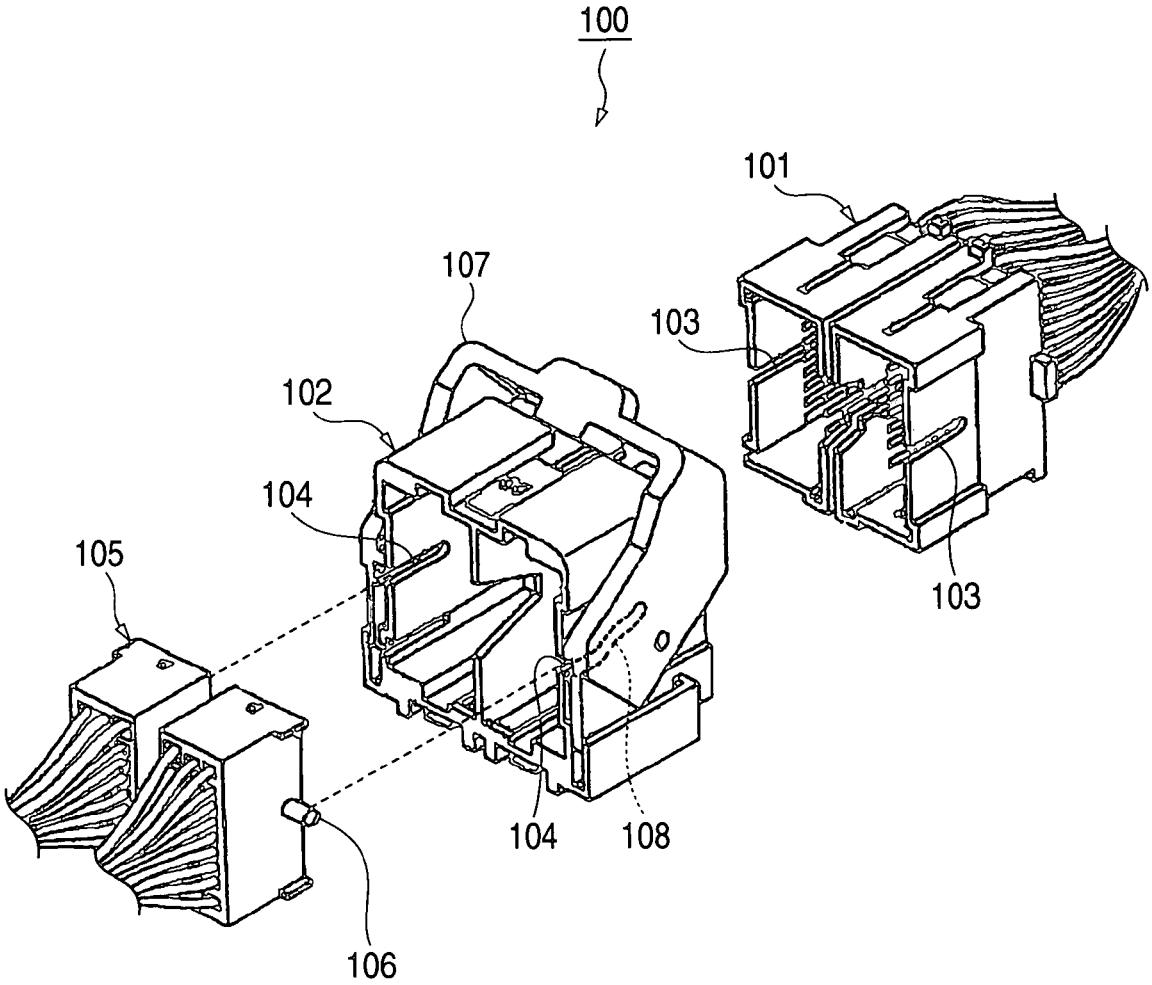
FIG. 10 is a schematic view of a conventional lever-type connector.

As shown in FIG. 9, a dustproof cover 13' includes a rectangular flat-plate-shaped cover portion 51, and a hood portion 52 which is composed of side wall portions 53 respectively provided vertically on the two side edges of the cover portion 51 and an upper wall portion 54 provided on the upper edge of the cover portion 51 integrally with the side wall portions 53.

The hood portion 52 is formed such that, when the dustproof cover 13' is mounted onto the connector housing 11, the side wall portions 53 cover the arm portions 41 of the lever 12 and the upper wall portion 54 covers the operation portion 43 of the lever 12. And, on the inner surface 54*a* of the upper wall portion 54, there are provided two ribs 58. These two ribs 58 serve as pressure portions which, as the dustproof cover 13 is mounted onto the connector housing 11, are pressed against the lock arm protect walls (the two side walls of the operation portion 42) of the lever 12.

The dustproof cover 13' is moved in such a manner that, while the terminal protect portion 55 is being inserted into the terminal storage room 22*a*, the arm portions 41 of the lever 12 are stored into clearances formed between the respective side walls 53 and the side walls 23 of the terminal storage room 22*a* opposed to the side walls 23, the operation portion 42 of the lever 12 is stored in a clearance formed between the upper wall portion 54 and the upper wall portion of the terminal storage room 22*a* opposed to the upper wall portion 54, and the opening of the terminal storage room 22*a* is covered from ahead by the cover portion 51. In the movement of the dustproof cover 13', the two ribs 58 provided on the inner surface 54*a* of the upper wall portion 54 are contacted with the above-mentioned lock arm protect walls of the lever 12 which is inclined forwardly.

As the dustproof cover 13' is moved further, the above-mentioned lock arm protect wall of the lever 12, while the front end face thereof is sliding on the end faces of the ribs 58 of the dustproof cover 13', is pressed backwardly by the ribs 58, whereby the lever 12 is inclined backwardly and is thus pushed back to the initial position. And, at the same time when the lever 12 is held at the initial position, the engaging pawls of the elastic engaging pieces 56 and 57 of the dustproof cover 13' are respectively engaged with the engaging portions 26 and 27 of the terminal storage room 22*a*, so that the dustproof cover 13' can be mounted onto the connector housing 11.

In a state where the dustproof cover 13' is mounted on the connector housing 11, the end faces of the ribs 58 of the dustproof cover 13' are pressed against the lock arm protect wall of the lever 12 and the inner surface 51*a* of the cover portion 51 of the dustproof cover 13' is pressed against the front end edges of the arm portions 41 of the lever 12, whereby the lever 12 is prevented from inclining forward and thus can be held at the initial position.

In the connector according to the present modification, when the lever 12 is pushed back to the initial position by the dustproof cover 13', the lever 12, specifically, the front end face of the lock arm protect wall of the lever 12 slides on the end faces of the ribs 51. Therefore, when compared with the previously described connector 1 in which the lever 12 slides on the inner surface 54*a* of the upper wall portion 54, the friction can be reduced. Thus, simultaneously when the dustproof cover 13' is mounted onto the connector housing 11, the lever 12 can be pressed, thereby being able to return the lever 12 to the initial position positively.

By the way, the invention is not limited to the above-mentioned embodiment and modification but other modifications and improvements are also possible according to cases. Also, the materials, shapes, dimensions, numerical values, types, number, arranging positions and the like of the respective composing elements of the above-mentioned embodiment and modification are not limitative but can be selected arbitrarily, provided that they can contribute toward attaining the invention.

What is claimed is:

1. A connector for mating with a partner connector having a cam pin, the connector comprising:

a connector housing including a guide groove for receiving the cam pin; and a lever including a cam groove engageable with the cam pin and rotatably supported on the connector housing;

wherein, in the initially engaged state of the connector and the partner connector, the cam pin is disposed in the entrance openings of the guide groove and the cam groove, and when the lever is operated and rotated, the cam pin is engaged with the cam groove and is pushed deep into the guide groove so that the connector is completely engaged with the partner connector;

wherein the connector further includes a dustproof cover removably mounted on the connector housing and covering the insertion opening of the connector housing into which the partner connector can be inserted and including a pressure portion to be pressed against the lever; and by pressing the lever using the pressure portion, the lever can be held at an initial position where the entrance opening of the cam groove coincides with the entrance opening of the guide groove.

2. The connector as set forth in claim 1, wherein the lever and the connector housing respectively include engaging portions which can be engaged with each other when the lever is held at the initial position.

3. The connector as set forth in claim 1, wherein the dustproof cover includes a hood portion for covering the lever.

4. The connector as set forth in claim 3, wherein the pressure portion is composed of a rib which is vertically provided on the inner surface of the hood portion.

* * * * *